US006264031B1

(12) United States Patent
Pienta et al.

(10) Patent No.: US 6,264,031 B1
(45) **Date of Patent: *Jul. 24, 2001**

(54) PACKAGE FOR A ROLL

(75) Inventors: David J. Pienta; Daniel J. Pienta, both of Lambertville, MI (US)

(73) Assignee: Automatic Handling, Inc., Erie, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/348,111

(22) Filed: Jul. 6, 1999

(51) Int. Cl.[7] ..... B65D 85/66
(52) U.S. Cl. ..... 206/410; 206/414
(58) Field of Search ..... 206/389, 398, 206/401, 410, 412, 413, 416, 414

(56) References Cited

U.S. PATENT DOCUMENTS

| | | | | |
|---|---|---|---|---|
| 2,067,111 | | 1/1937 | Aberle . | |
| 2,250,875 | | 7/1941 | McConnell . | |
| 3,895,711 | | 7/1975 | Hiltunen et al. . | |
| 3,924,375 | | 12/1975 | Brenner et al. . | |
| 4,235,062 | | 11/1980 | Lancaster, III et al. . | |
| 4,281,500 | | 8/1981 | Mueller et al. . | |
| 4,736,567 | | 4/1988 | Pienta . | |
| 4,746,011 | | 5/1988 | McNair, Jr. et al. . | |
| 4,882,892 | | 11/1989 | Pienta . | |
| 4,884,385 | | 12/1989 | Mushinski et al. . | |
| 4,886,167 | | 12/1989 | Dearwester . | |
| 4,936,459 | | 6/1990 | Mushinski et al. . | |
| 5,007,538 | | 4/1991 | Mushinski et al. . | |
| 5,046,298 | | 9/1991 | Norkoski et al. . | |
| 5,090,566 | * | 2/1992 | Yount | 206/416 |
| 5,131,209 | | 7/1992 | Schreiber et al. . | |
| 5,346,067 | * | 9/1994 | Haufe et al. | 206/413 X |
| 5,366,085 | * | 11/1994 | Kewin | 206/413 |
| 5,487,255 | | 1/1996 | Soderberg . | |
| 5,850,918 | | 12/1998 | Pienta . | |
| 5,873,464 | | 2/1999 | Haley . | |
| 5,890,591 | | 4/1999 | Pienta . | |

FOREIGN PATENT DOCUMENTS

| | | |
|---|---|---|
| 41 37 448 A1 | 5/1993 | (DE) . |
| 0519 672 A1 | 12/1992 | (EP) . |
| WO 92/17371 | 10/1992 | (WO) . |
| WO 98/57854 | 12/1998 | (WO) . |

OTHER PUBLICATIONS

Film Roll Wrapping with AutoWrappers Brochure, published by Automatic Handling, undated.
Mark McCready, Automatic Handling's innovative Philosophy Keeps it Rolling Along, Nov. 1989, pp. 28–30.
Zero–in on Zero Damage! pamphlet, published by Automatic Handling, Jan. 1996.
Stop Roll Damage! pamphlet, published by Automatic Handling, Apr. 1996.
Ten Steps to Zero Roll Damage advertisement, Converting Today, Jun. 1996.
Trancel Combination Roll Wrapping System Brochure, published by Trancel, Inc., undated.
Heavy Duty Wrap and Roll pamphlet, published by Teno, undated.
Film Roll Wrapping Colutions for the Pulp and Paper Industry by Mechadyne Engineering & Machine, Sep. 1994.
Drautzburg R: "Neue Verpackungstechnologie in der Coilverpackung" Stahl und Eisen, vol. 112, No. 7, Jul. 15, 1992, pp. 47–48.

* cited by examiner

*Primary Examiner*—Jim Foster
(74) *Attorney, Agent, or Firm*—Emch, Schaffer, Schaub & Porcello Co., L.P.A.

(57) ABSTRACT

A package for a paper roll having a longitudinal axis, a pair of spaced ends and an outer surface extending between the ends and radially spaced from the axis. The package includes an inner layer positioned over the outer surface in a direction substantially parallel to the axis. A middle layer of paper material is positioned over the inner layer in a direction substantially perpendicular to the axis. The package includes an outer layer positioned over the middle layer in a direction substantially perpendicular to the axis. The package is moisture resistant, easy to stack and fire resistant.

5 Claims, 8 Drawing Sheets

PACKAGE FOR A ROLL

BACKGROUND OF THE INVENTION

The present invention relates generally to a package for a roll. More specifically, the invention is directed to a package including layers of materials positioned over the outer surface of the roll.

It has been found that there is a need for a package for a roll that is moisture resistant, easy to stack and is relatively fire resistant. The present invention satisfies this need.

SUMMARY OF THE INVENTION

The present invention is a package including a roll, such as a paper roll, having a longitudinal axis, a pair of spaced ends and an outer surface extending between the ends and radially spaced from the axis. The package includes an inner layer positioned over the outer surface in a direction substantially parallel to the axis. A middle layer is positioned over the inner layer in a direction substantially perpendicular to the axis. The middle layer is a paper material. The package includes an outer layer positioned over the middle layer in a direction substantially perpendicular to the axis.

The primary object of the present invention is to provide a package that is moisture resistant.

An important object of the present invention is to provide a package that is easy to stack.

An important object of the present invention is to provide a package that is relatively fire resistant.

Other objects and advantages of the present invention will become apparent to those skilled in the art upon a review of the following detailed description of the preferred embodiments and the accompanying drawings.

DETAILED DESCRIPTION OF THE PREFERRED EMBODIMENTS

Figure 1A:
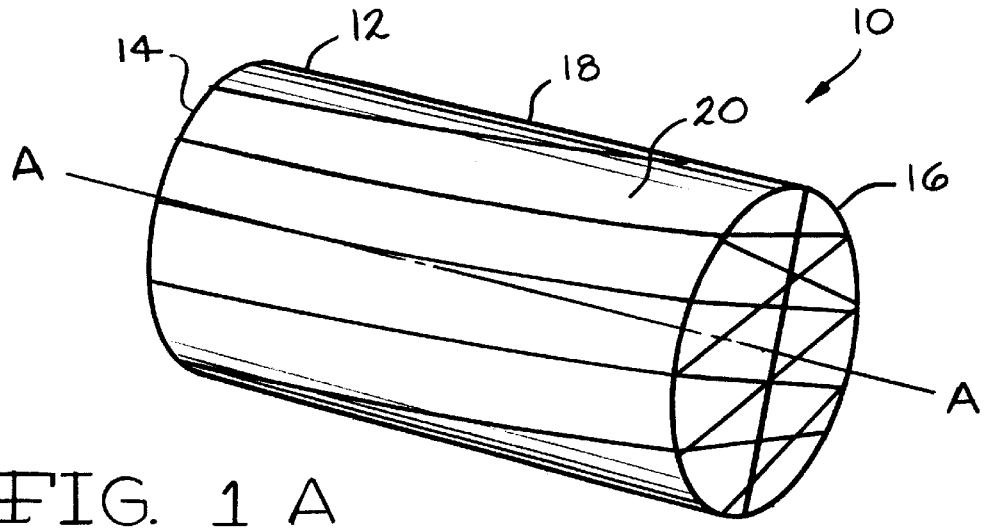
FIG. 1A is a perspective view of a package, according to the present invention, after an inner layer of material has been applied to the roll being wrapped.

The preferred embodiments and best mode of the present invention will now be described in detail with reference being made to the drawings. Referring to FIGS. 1A–E, the first embodiment package 10 includes a paper roll 12 having a longitudinal axis A. The roll 12 includes a first end 14 and a second end 16. The roll 12 includes an outer surface 18 extending between the first and second ends 14 and 16 and radially spaced from the axis A.

As shown in FIG. 1A, the package 10 includes an inner layer 20 positioned over the outer surface 18 and the first and second ends 14 and 16 in a direction substantially parallel to the axis A. The inner layer 20 is preferably a plastic stretch film normally having a thickness between 60 gauge and 300 gauge.

Figure 1B:
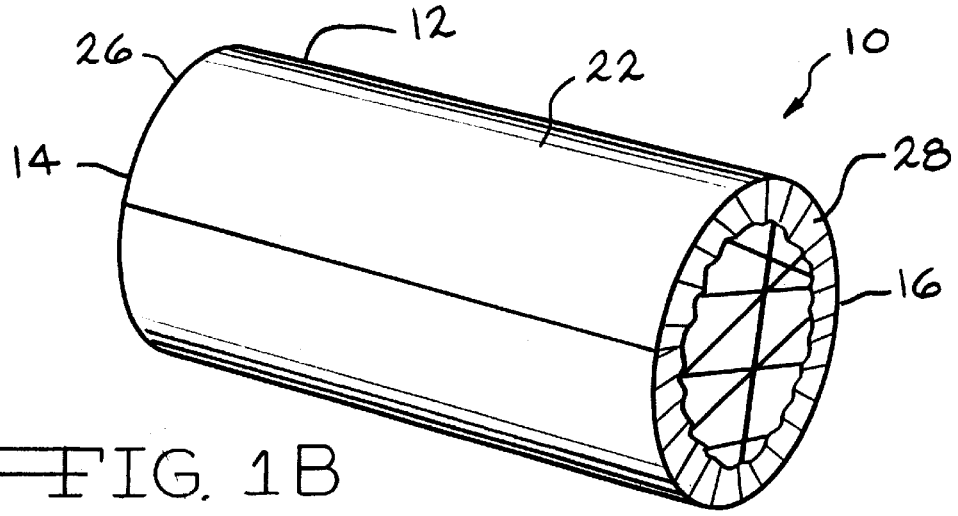
FIG. 1B is a perspective view of the roll shown in FIG. 1A after a middle layer of paper material has been applied to the roll.
Figure 1C:
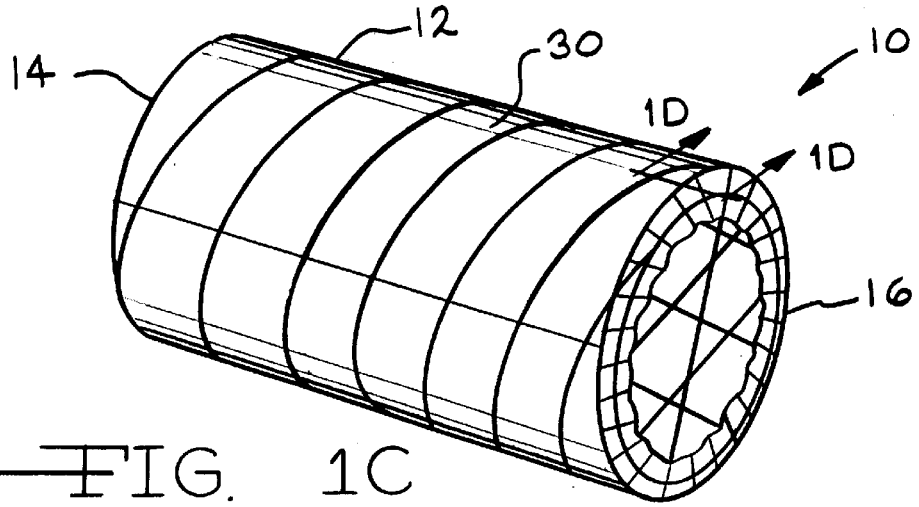
FIG. 1C is a perspective view of the roll shown in FIG. 1A after an outer layer of material has been applied to the roll.
Figure 1D:
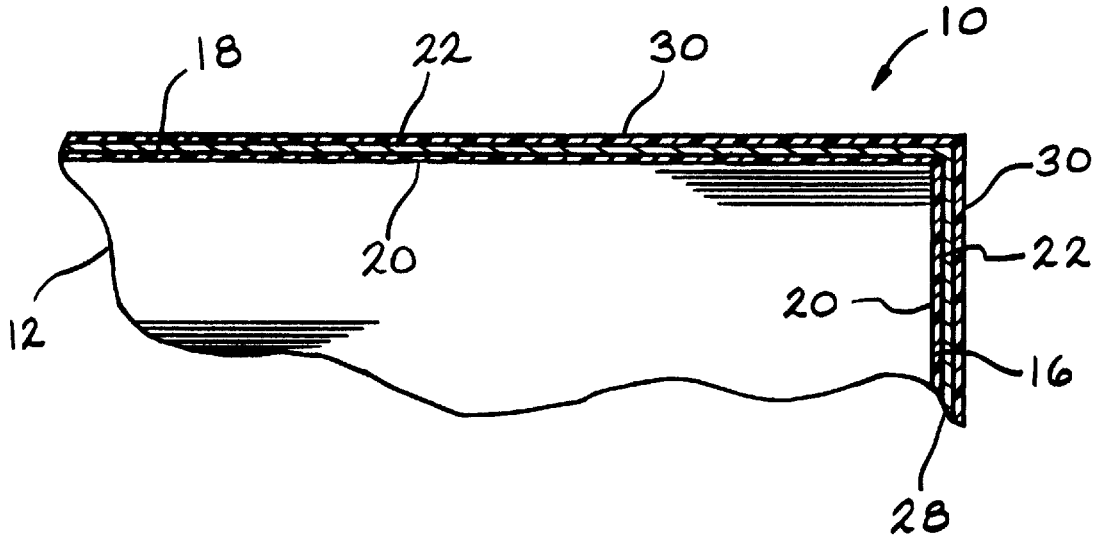
FIG. 1D is a cross-sectional view taken along line 1D—1D of FIG. 1C.
Figure 1E:
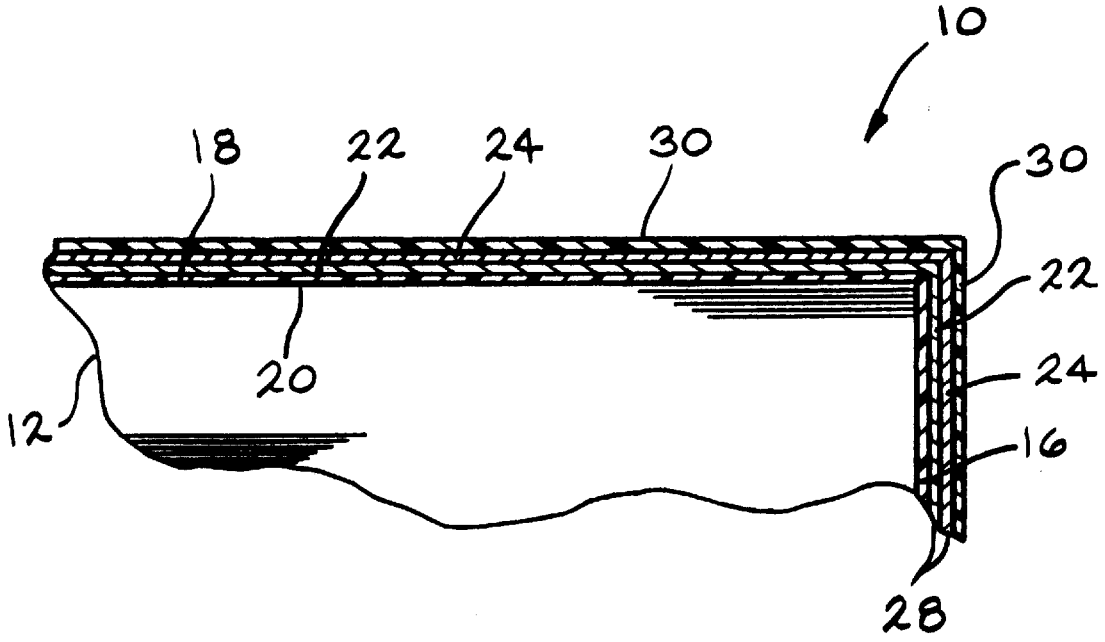
FIG. 1E is a cross-sectional view similar to the view of FIG. 1D showing two middle layers of paper material according to the present invention.

Referring to FIGS. 1B, 1D and 1E, the package 10 includes at least one middle layer 22 positioned over the inner layer 20 in a direction substantially perpendicular to the axis A. As shown in FIG. 1D, the package 10 includes a single middle layer 22. In some applications, the package 10 includes two or more layers 22 and 24 as shown in FIG. 1E. Referring again to FIG. 1B, the middle layer 22 includes first and second edge portions 26 and 28 positioned over the first and second ends 14 and 16, respectively, of the roll 12.

The middle layer 22 is a wrapping paper material normally having a basis weight between 16 pounds and 150 pounds with 20 pounds to 40 pounds being preferred. An example of a suitable wrapping paper material is kraft paper.

Referring to FIG. 1C, the package 10 includes an outer layer 30 positioned over the middle layer 22 in a direction substantially perpendicular to the axis A. The outer layer 30 is preferably a plastic stretch film normally having a thickness between 60 gauge and 300 gauge.

Figure 2A:
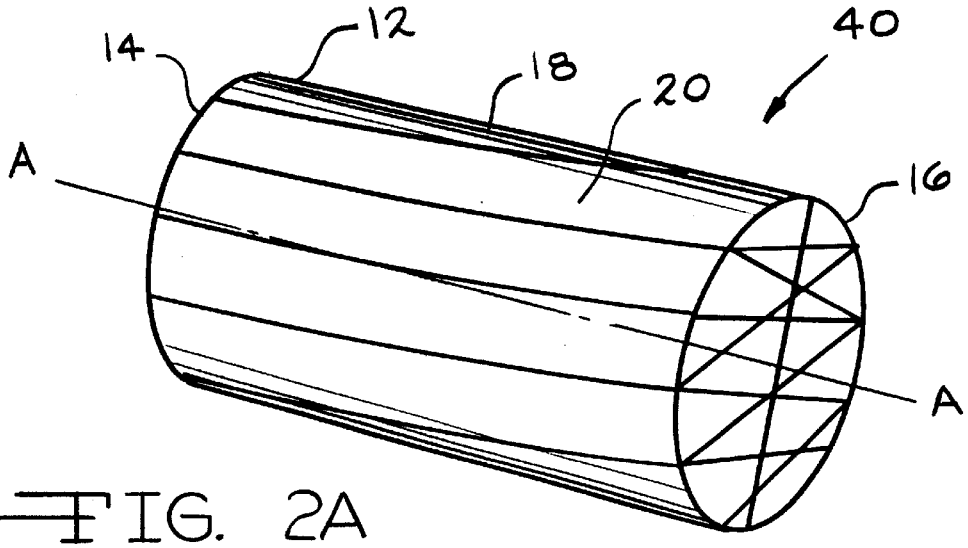
FIG. 2A is a perspective view of a second embodiment package, according to the present invention, after an inner layer of material has been applied to the roll being wrapped.
Figure 2B:
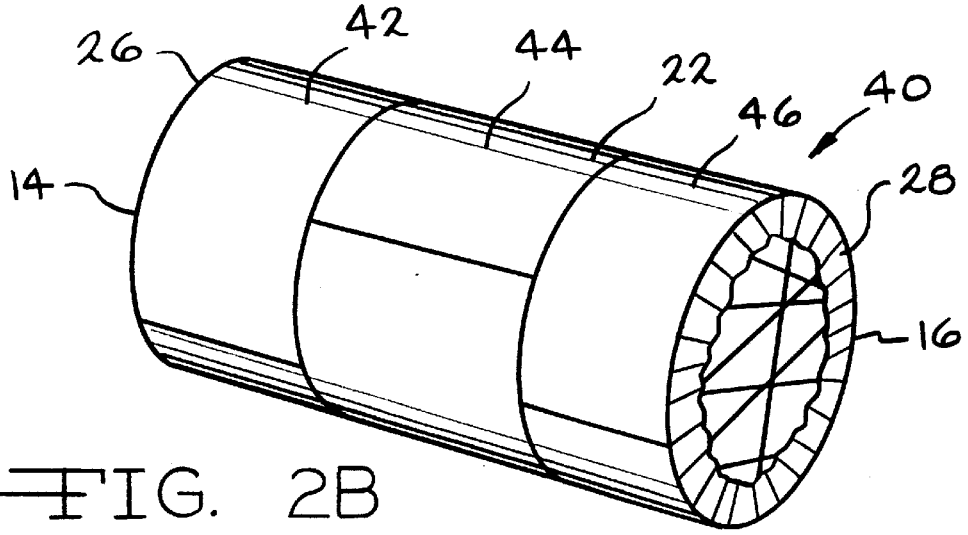
FIG. 2B is a perspective view of the roll shown in FIG. 2A after a middle layer of multiple widths of paper material has been applied to the roll.
Figure 2C:
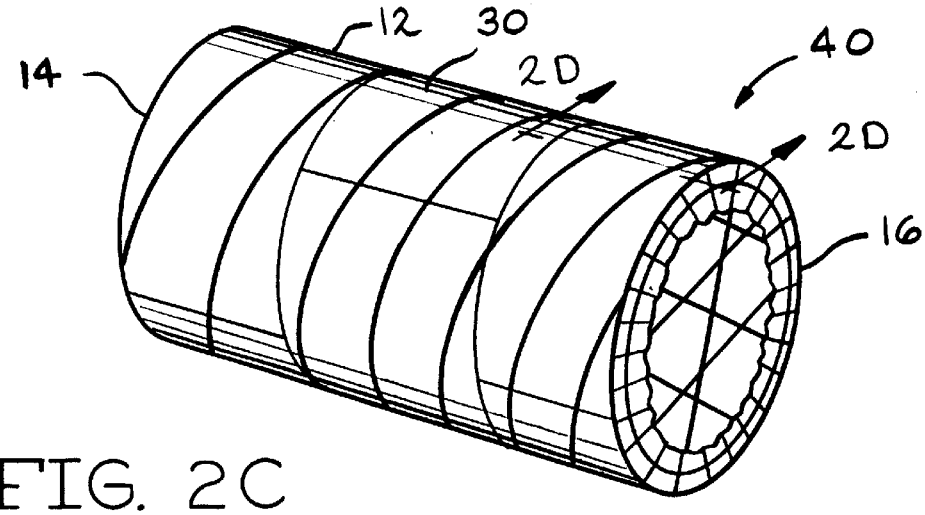
FIG. 2C is a perspective view of the roll showing FIG. 2A after an outer layer of material has been applied to the roll.
Figure 2D:
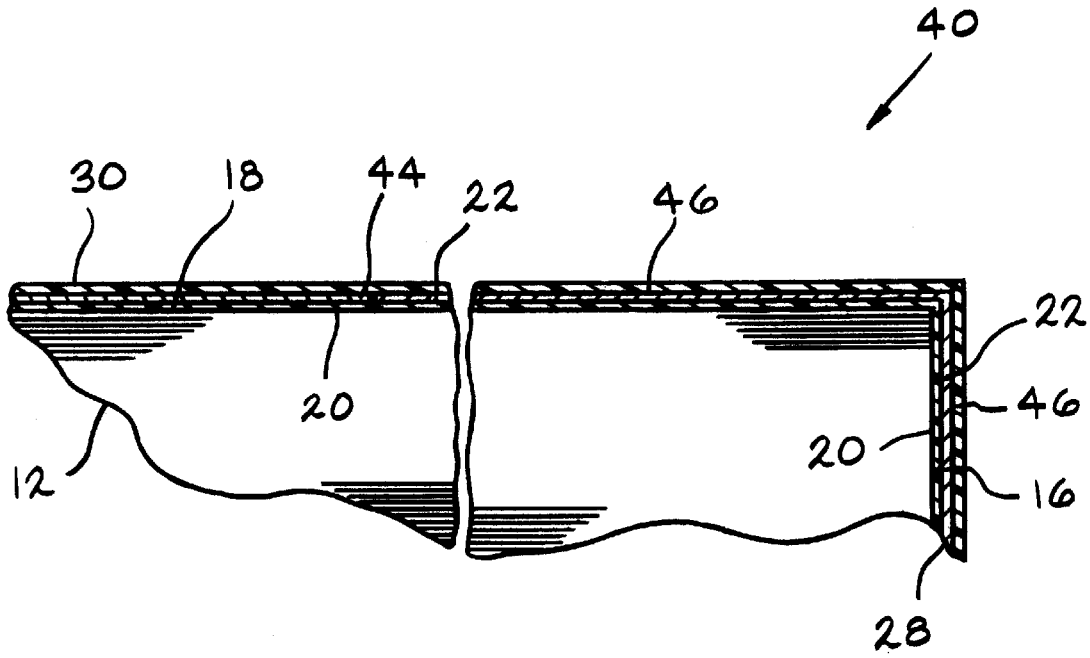
FIG. 2D is a cross-sectional view take along line 2D—2D of FIG. 2C.

A second embodiment package 40, according to the present invention, is shown in FIGS. 2A–D. The package 40 includes all of the elements described above with respect to the first embodiment package 10. In the package 40, the middle layer 22 includes first, second and third widths of wrapping paper material 42, 44 and 46 as shown in FIG. 2B.

Figure 3A:
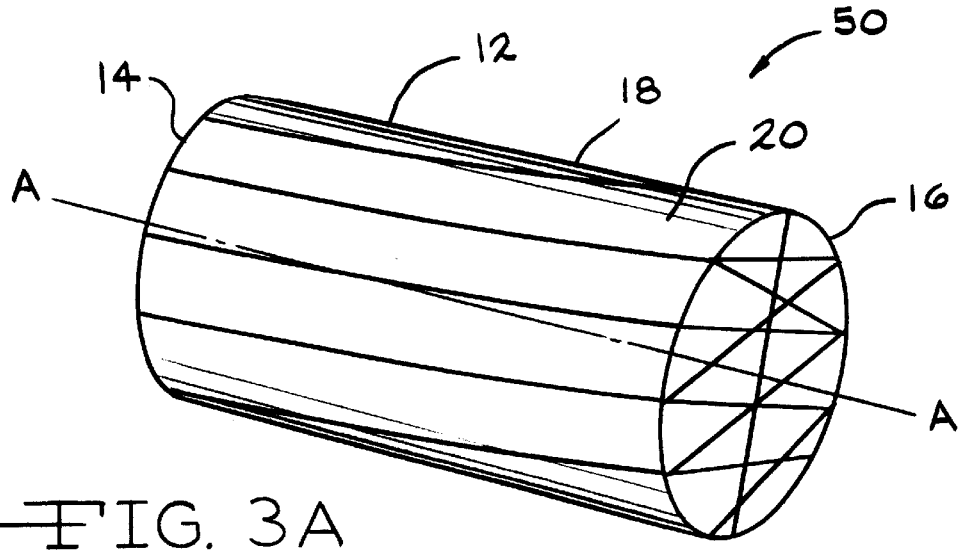
FIG. 3A is a perspective view of a third embodiment package, according to the present invention, after an inner layer of material has been applied to the roll being wrapped.
Figure 3B:
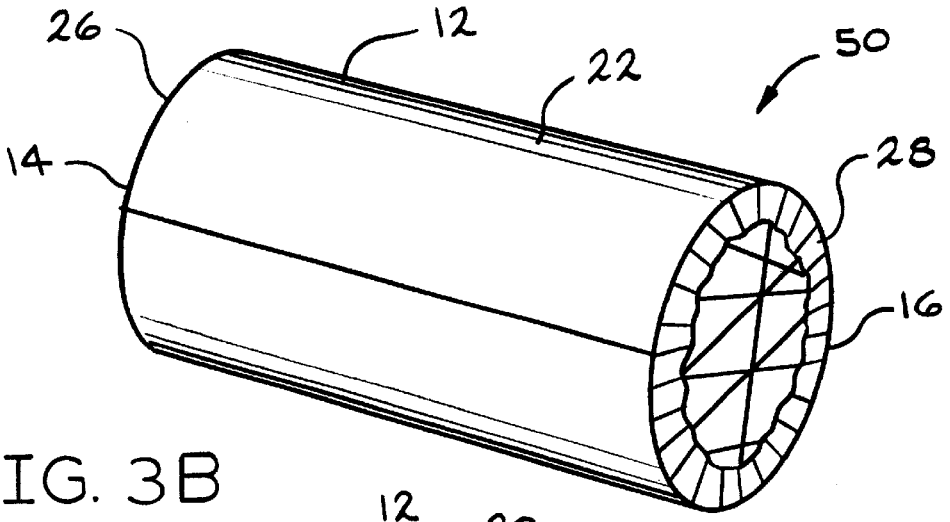
FIG. 3B is a perspective view of the roll shown in FIG. 3A after a middle layer of paper material has been applied to the roll.
Figure 3C:
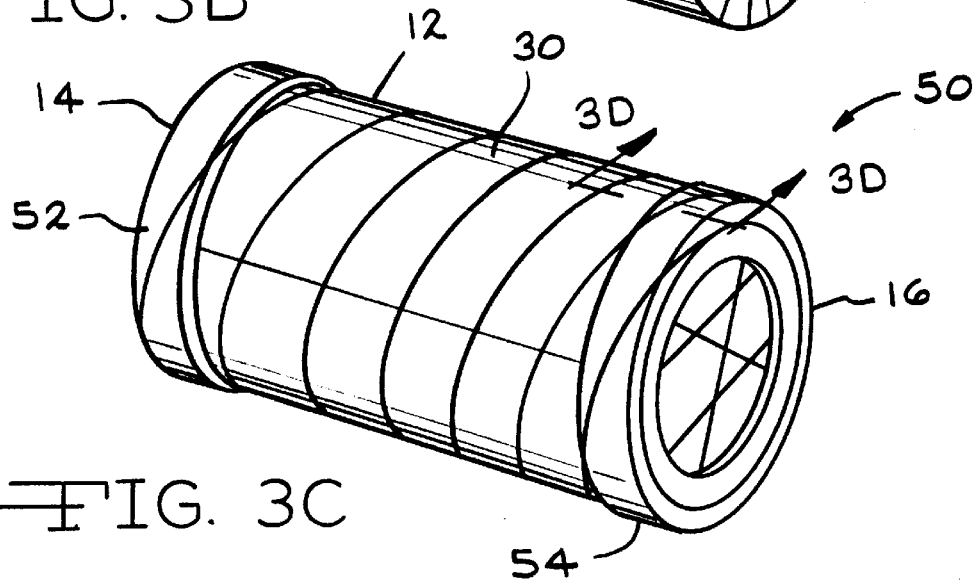
FIG. 3C is a perspective view of the roll shown in FIG. 3A after edge protection layers and an outer layer of material have been applied to the roll.
Figure 3D:
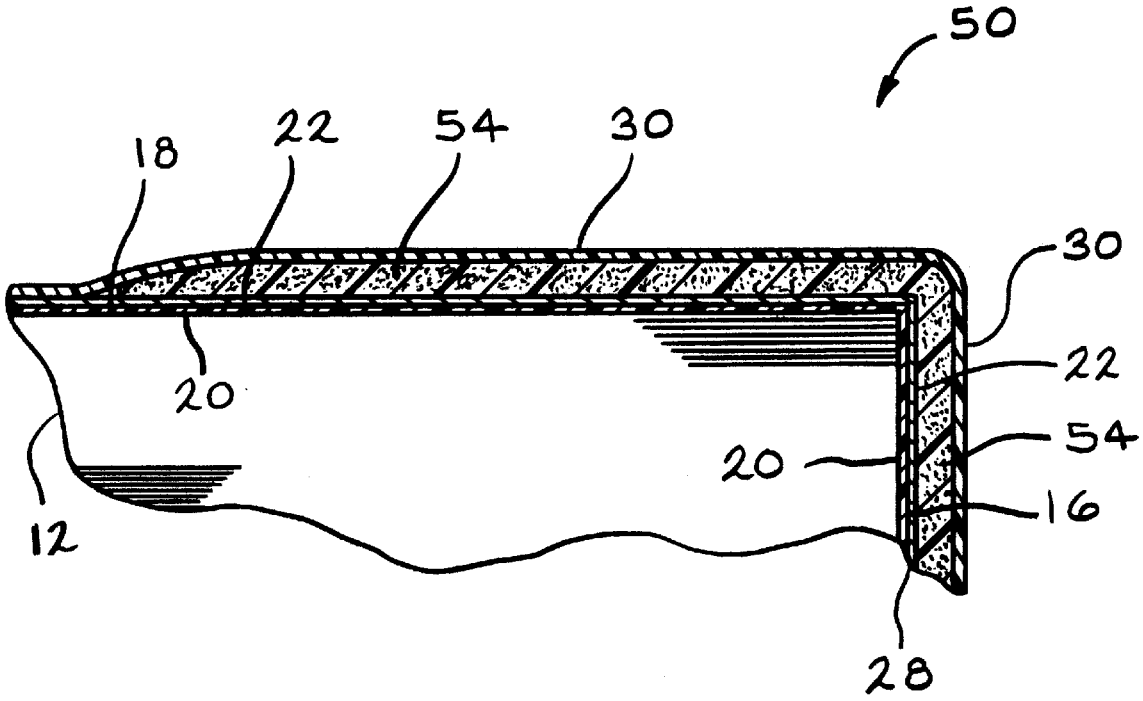
FIG. 3D is a cross-sectional view taken along line 3D—3D of FIG. 3C.
Figure 4A:
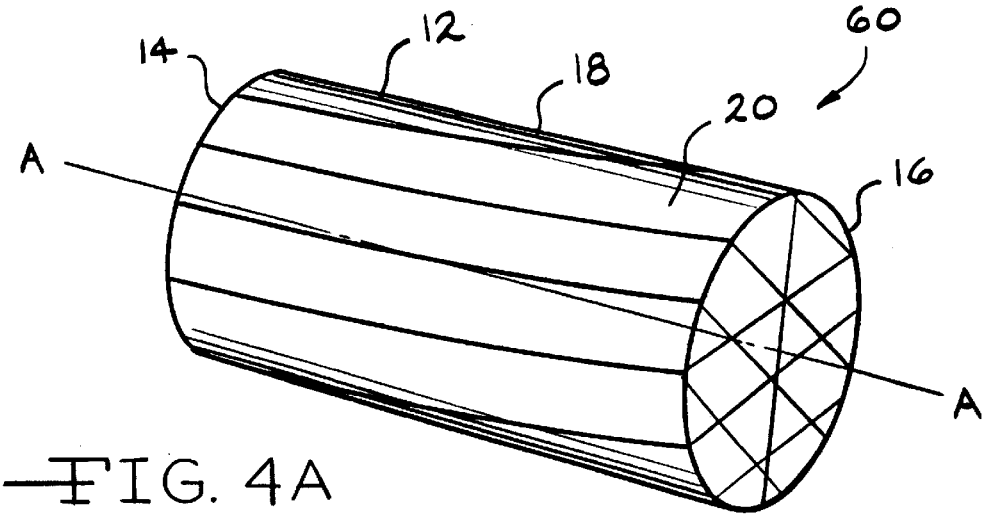
FIG. 4A is a perspective view of a fourth embodiment package, according to the present invention, after an inner layer of material has been applied to the roll being wrapped.
Figure 4B:
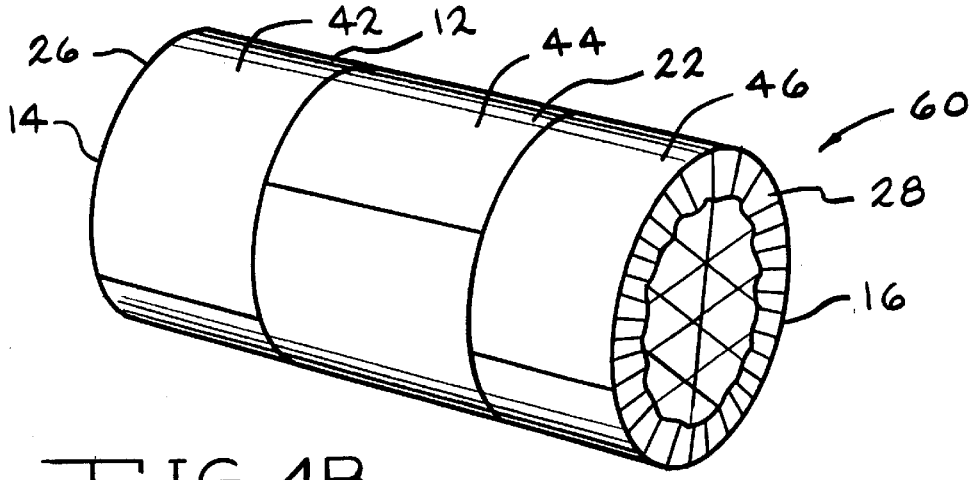
FIG. 4B is a perspective view of the roll shown in FIG. 4A after a middle layer of multiple widths of paper material has been applied to the roll.
Figure 4C:
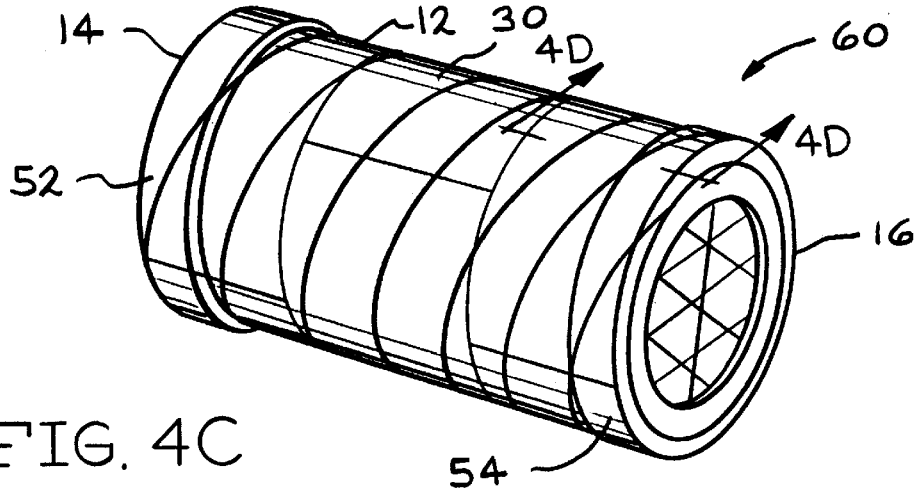
FIG. 4C is a perspective view of the roll shown in FIG. 4A after edge protection layers and an outer layer of material have been applied to the roll.
Figure 4D:
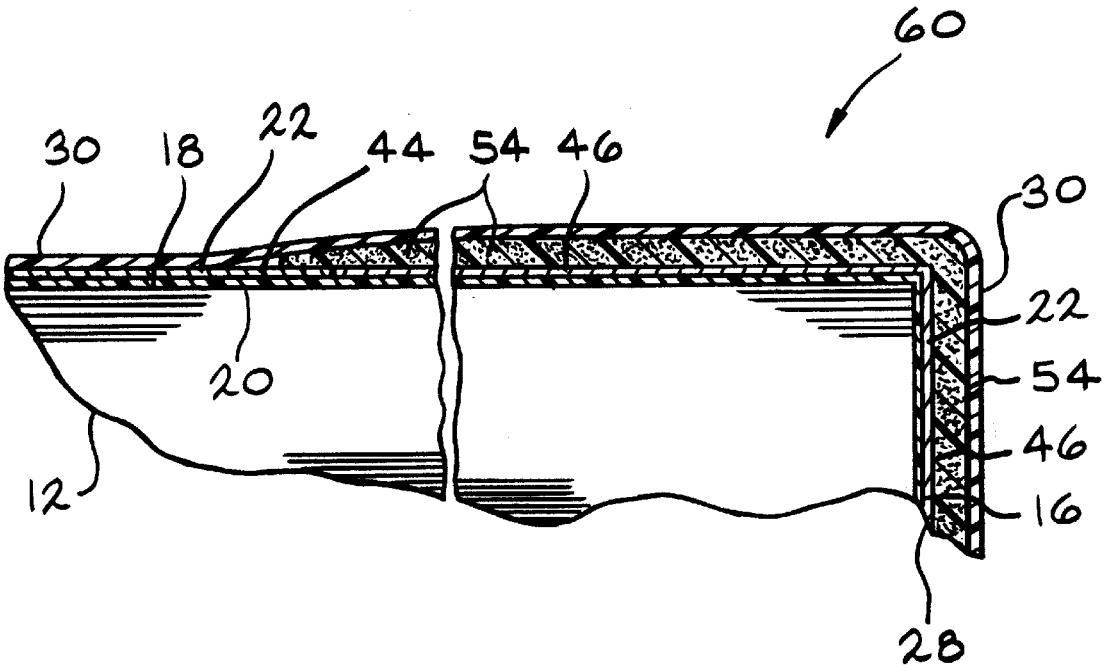
FIG. 4D is cross-sectional view taken along line 4D—4D of FIG. 4C.

A third embodiment package, according to the present invention, is shown in FIGS. 3A–D. The package 50 includes all of the elements described above for the first embodiment package 10. As shown in FIGS. 3C and 3D, the package 50 further includes first and second edge protection layers 52 and 54 positioned over the outer surface 18 and the first and second ends 14 and 16, respectively, of the roll 12. As shown in FIG. 3D, the first and second edge protection layers 52 and 54 are positioned between the middle layer 22 and the outer layer 30. The first and second edge protection layers 52 and 54 are preferably a cusioned material having a thickness between an ⅛ inch and ¾ inch. Examples of suitable cushioned materials include foamed materials and bubble wrap materials.

Referring to FIGS. 4A–D, a fourth embodiment package 60, according to the present invention, is shown. The package 60 includes all of the elements described above with respect to the package 10. The package 60 further includes the first, second and third widths of wrapping paper material 42, 44 and 46 as described with respect to the embodiment of the invention shown in FIG. 2B and the first and second edge protection layers 52 and 54 as described with respect to the embodiment of the invention shown in FIG. 3C.

It has been found that the present invention provides a package that is moisture resistant, easy to stack and relatively fire resistant.

The above detailed description of the present invention is given for explanatory purposes. It will be apparent to those skilled in the art that numerous changes and modifications can be made without departing from the scope of the invention. Accordingly, the whole of the foregoing description is to be construed in an illustrative and not a limitative sense, the scope of the invention being defined solely by the appended claims.

We claim:

1. A package for a paper roll comprising:

a paper roll having a pair of spaced ends and an outer surface extending between said ends;

an inner layer of plastic film positioned over said outer surface;

a middle layer of wrapping paper positioned over said inner layer; and an outer layer of plastic film positioned over said middle layer.

2. The package of claim 1, wherein said wrapping paper has a basis weight in the range from about 16 pounds to about 150 pounds.

3. The package of claim 1, wherein said middle layer is positioned over a portion of at least one of said spaced ends of said roll.

4. The package of claim 1, wherein said package includes an edge protection layer positioned over a portion of said outer surface and a portion of at least one of said spaced ends between said middle layer and said outer layer.

5. The package of claim 4, wherein said edge protection layer is a cushioned material.

* * * * *